US008020594B2

(12) United States Patent
Kokko

(10) Patent No.: US 8,020,594 B2
(45) Date of Patent: Sep. 20, 2011

(54) DEBARKING MECHANISM

(75) Inventor: Pekka Kokko, Hollola (FI)

(73) Assignee: Andritz Oy, Helsinki (FI)

( * ) Notice: Subject to any disclaimer, the term of this patent is extended or adjusted under 35 U.S.C. 154(b) by 707 days.

(21) Appl. No.: 11/568,129

(22) PCT Filed: Apr. 19, 2005

(86) PCT No.: PCT/FI2005/050126

§ 371 (c)(1),
(2), (4) Date: Oct. 20, 2006

(87) PCT Pub. No.: WO2005/102635

PCT Pub. Date: Nov. 3, 2005

(65) Prior Publication Data

US 2009/0151817 A1 Jun. 18, 2009

(30) Foreign Application Priority Data

Apr. 20, 2004 (FI) ..... 20045140

(51) Int. Cl.
*B27L 1/00* (2006.01)
*B27L 1/10* (2006.01)

(52) U.S. Cl. ..... 144/208.1; 144/208.5

(58) Field of Classification Search ..... 144/208.1, 144/208.4, 208.5, 208.9
See application file for complete search history.

(56) References Cited

U.S. PATENT DOCUMENTS

| | | | | |
|---|---|---|---|---|
| 5,394,912 | A * | 3/1995 | Hume | 144/208.1 |
| 5,699,843 | A * | 12/1997 | Gagne | 144/208.9 |
| 6,588,467 | B2 * | 7/2003 | Havumaki et al. | 144/208.9 |
| 6,619,345 | B2 * | 9/2003 | Havumaki et al. | 144/208.9 |
| 6,619,346 | B2 * | 9/2003 | Havumaki et al. | 144/208.9 |
| 2003/0159760 | A1 | 8/2003 | Peetso et al. | |

FOREIGN PATENT DOCUMENTS

| | | |
|---|---|---|
| FI | 28777 | 4/1957 |
| FI | 112181 | 11/2003 |
| SE | 8007901 | 5/1982 |

OTHER PUBLICATIONS

International Search Report mailed Aug. 29, 2005.
Written Opinion mailed Aug. 29, 2005.

* cited by examiner

*Primary Examiner* — Shelley Self
(74) *Attorney, Agent, or Firm* — Nixon & Vanderhye P.C.

(57) ABSTRACT

The invention relates to a debarking mechanism (1) for the decortication or pretreatment of logs (2) for separately performed final debarking and for the discharge of at least some of the bark removed from a wood stream passing through the debarking mechanism, the said debarking mechanism comprising a number of rotatable debarking shafts (3, 3') extending parallel to an advancing direction (A) of the logs (2) to be fed therethrough, which are provided with a number of teeth (4) extending beyond the circumferential surface of the shaft (3, 3').

10 Claims, 5 Drawing Sheets

DEBARKING MECHANISM

This application is the US national phase of international application PCT/FI2005/050126 filed 19 Apr. 2005 which designated the U.S. and claims benefit of FI 20045140 filed 20 Apr. 2004, the entire contents of which are hereby incorporated by reference.

BACKGROUND AND SUMMARY OF INVENTION

The invention relates to a debarking mechanism for the decortication or pretreatment of logs for separately performed final debarking and for the discharge of at least some of the bark removed from a log stream passing through the debarking mechanism, the debarking mechanism comprising a number of rotatable debarking shafts extending parallel to the advancing direction of the logs to be fed therethrough, which are provided with a number of teeth extending beyond the circumferential surface of the shaft and arranged to strip bark off the logs being processed, transversely to the longitudinal direction of the logs, and at the same time to convey the logs transversely relative to the said shafts, the said shafts, together with the teeth thereof, being arranged to form at least a part of a support surface, on which the logs being processed travel through the debarking mechanism, and the said debarking shafts being arranged relative to each other in such a way that the logs being processed perform a rotary motion in the debarking mechanism, in which motion the logs on the support surface formed by the debarking shafts, are forced, in their turn, by the effect of the rotary motion of the debarking shafts, into the upper position, from which they roll down into the lower position on top of the other logs in the debarking mechanism.

This type of prior known debarking mechanisms are provided with fingerplates between the uppermost debarking shaft and the side wall of the debarking mechanism—in some mechanisms also between the debarking shafts—to prevent logs from being wedged between the debarking shaft and the side wall of the debarking mechanism or between two debarking shafts, and thus to prevent the wedged log from being broken.

The bark can usually be discharged from between the debarking shaft and the fingerplate or between two debarking shafts. Bark detached from the logs in long strips causes problems by clogging the gaps between the uppermost debarking shaft and the related fingerplates, thus causing the bark to collect into big clots at these uppermost fingerplates.

In order to eliminate these disadvantages, the debarking mechanism of the invention has been arranged in such a way that of the debarking shafts forming the said part of the support surface for the logs, at least the uppermost debarking shaft has been moved sideways towards the inner part of the debarking mechanism in such a way that the said debarking shaft directs an impact effect on logs colliding with it and moved by the debarking shafts located in a lower position, due to the effect of which the direction of movement of the logs having collided with the said debarking shaft will change in such a way that, when dividing the movement into a horizontal and a vertical component, the horizontal component of movement will point towards the inner part of the debarking mechanism, that the circumferential speed of the debarking shaft is selected to be the greater the higher the debarking shaft is positioned, and that a free passage has been arranged for the bark passing over the uppermost debarking shaft, along which the bark is discharged from the debarking mechanism.

The new position of the uppermost debarking shaft has the effect that, at best, the logs cannot rise above this uppermost debarking shaft at all. The arrangement here is that a free passage is arranged for the bark passing over the uppermost debarking shaft, along which the bark is discharged from the debarking mechanism. This may be realized, for example, by arranging an opening in the side wall of the debarking mechanism at the uppermost debarking shaft, in such a way that the bark conveyed by the uppermost debarking shaft are removed from the debarking mechanism through the said opening.

It is further arranged that the higher the position of the debarking shaft, the greater the selected circumferential speed of the debarking shaft. On the one hand, this arrangement prevents the logs from being wedged between the debarking shafts and, on the other hand, facilitates the discharge of the bark from debarking mechanism.

After the said uppermost debarking shaft may of course also be arranged further debarking shafts or similar means, for example, for the further conveyance of the bark. What is essential, however, is that any such additional shafts are no longer comprised in the above-mentioned support surface formed by the debarking shafts, on which surface the logs being processed travel through the debarking mechanism. The purpose of the said uppermost debarking shaft is precisely to prevent the logs from entering the area above the said support surface.

Normally, however, provisions must be made for the logs at least occasionally rising above the uppermost debarking shaft. For such a case, the arrangement is preferably such that a guiding surface is fitted in conjunction with the uppermost debarking shaft, the said guiding surface forming, together with the uppermost debarking shaft, a slot converging in the direction of rotation of the debarking shaft. On the one hand, a guiding surface of this type facilitates the entry of the bark into the said slot and, on the other hand, prevents the logs from entering into the slot between the guiding surface and the uppermost debarking shaft.

The guiding surface is preferably provided with grooves for interlocking the said guiding surface and the teeth of the uppermost debarking shaft.

A freely rotating roller or a roller rotated by a suitable actuator has proven to be the most efficient embodiment of the guiding surface.

The invention will be described in greater detail in the following, with reference to the accompanying drawings, in which.

Figure 2:
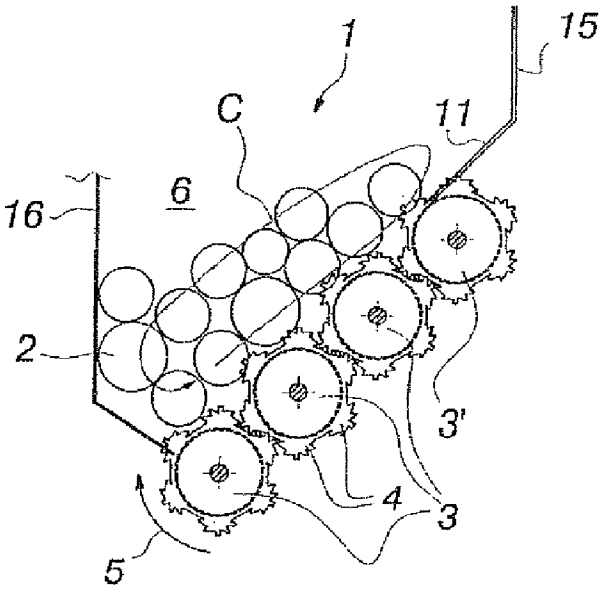
Prior art Fig. 2
FIG. 2 shows a section along line II-II in FIG. 1.

The debarking mechanism 1 shown in the drawings is intended for the decortication or pretreatment of logs 2 for separately performed final debarking and for the discharge of at least some of the bark removed from the wood stream passing through the debarking mechanism.

The debarking mechanism 1 comprises a number of rotatable debarking shafts 3, 3' extending parallel to the advancing direction A (FIG. 1) of the logs 2 to be fed therethrough, the ends of the debarking shafts being pivoted on the end plates 13 (FIG. 1) at the ends of the debarking mechanism 1. To rotate the shafts 3, 3', one or both of their ends is provided with, for example, a sprocket 14. The shafts 3, 3' are rotated in the direction of the arrow 5 (FIG. 2).

The debarking shafts 3, 3' are provided with a number of teeth 4 extending beyond the circumferential surface of the debarking shaft and arranged to strip bark off the logs 2 being processed transversely to the longitudinal direction of the logs and at the same time to convey the logs transversely relative to the said debarking shafts.

Figure 1:
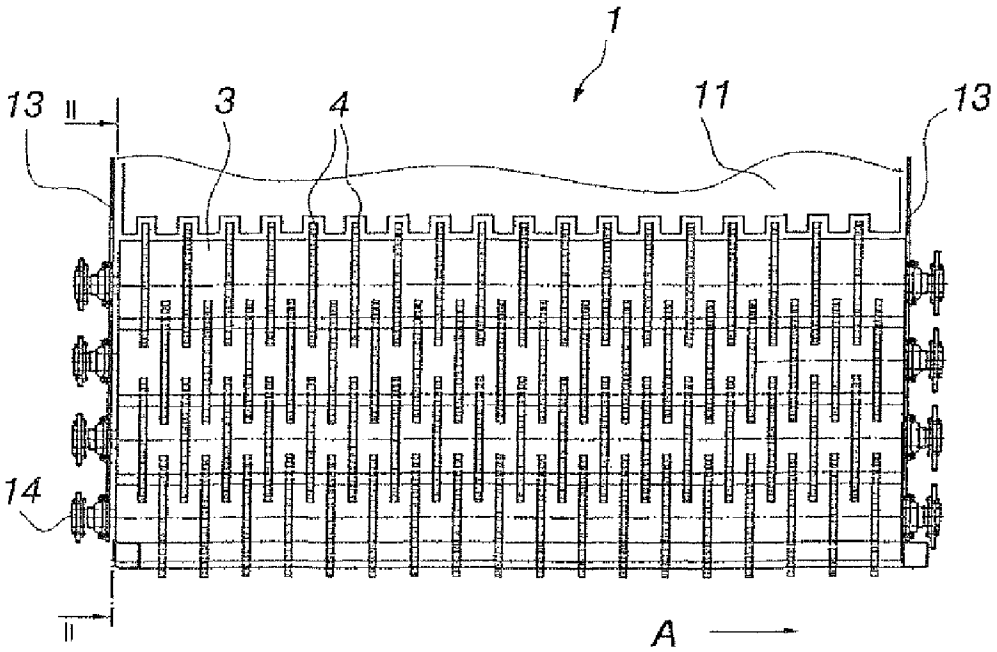
Prior art Fig. 1
FIG. 1 shows the debarking shafts of a prior art debarking mechanism as a schematic side view.

The debarking shafts 3, 3', together with the teeth 4 thereof, form a part of the support surface carrying the logs 2 through the debarking mechanism 1. FIGS. 1 and 2 show an example of a prior art mechanism comprising four debarking shafts 3, 3', the said shafts being arranged relative to each other so as to form an inclined plane, as can be best seen in FIG. 2. The debarking shafts 3, 3' form a sloping plane also in the advancing direction A of the logs. Other than that, the support surfaces are solid surfaces 15, 16 designed so as to provide, together with the support surface formed by the debarking shafts, an open-ended chute extending from one end of the debarking mechanism 1 to the other.

The debarking shafts 3, 3' are arranged with each other in such a way that the processed logs 2 perform a rotary motion C 12 in the debarking mechanism, in which motion the logs 2 are forced on the support surface formed by the debarking shafts 3, 3' by the effect of the rotary motion 5 of the debarking shafts 3, 3' in their turn into the upper position, from which they roll down into the lower position on top of the other logs 2 being processed in the debarking mechanism 1.

In the prior art FIGS. 1 and 2, a fingerplate 11 is arranged above the uppermost debarking shaft 3', the purpose of the fingerplate being to prevent the logs from being wedged between the uppermost debarking shaft 3' and the side wall of the debarking mechanism 1. The bark can usually be discharged from between the debarking shaft 3' and the fingerplate 11 or between two debarking shafts 3 and fall down onto the bark conveyor underneath (not shown).

However, especially bark detached in long strips sometimes causes problems by clogging the gaps between the uppermost debarking shaft 3' and the related fingerplates 11, thus causing the bark to collect into big clots at these uppermost fingerplates 11.

Figure 3:
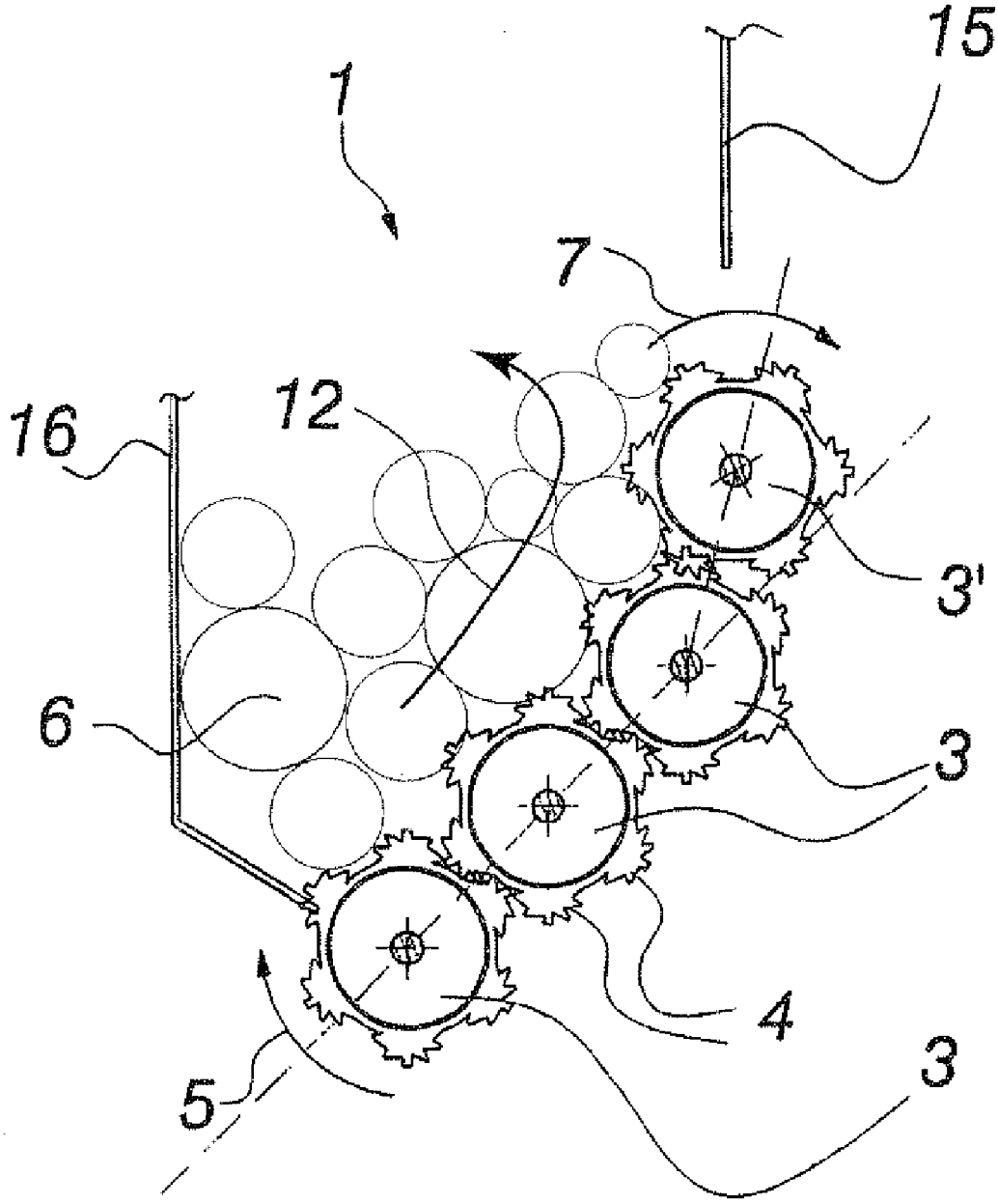
FIG. 3 shows a section of FIG. 2 of the debarking mechanism in accordance with the first embodiment of the invention.

To eliminate the said problem, FIG. 3 shows diagrammatically a solution, in which the uppermost debarking shaft 3', has been moved sideways towards the inner part 6 of the debarking mechanism 1 in such a way that the said debarking shaft directs an impact effect on logs (2) colliding with it and moved by the debarking shafts (3) located in a lower position, due to the effect of which the direction of movement of the logs (2) having collided with the said debarking shaft will change in such a way that, when dividing the movement into a horizontal and a vertical component, the horizontal component of movement will point towards the inner part 6 of the debarking mechanism 1.

In a solution according to the invention, the circumferential speed of the debarking shaft 3, 3' is selected to be the greater the higher the debarking shaft 3, 3' is positioned. On the one hand, this arrangement prevents the logs 2 from being wedged between the debarking shafts 3, 3', and on the other hand facilitates the removal of the bark from the debarking mechanism 1.

When the selected sideways movement of the debarking shaft 3' is extensive enough, the logs 2 are prevented from passing beyond the uppermost debarking shaft 3'. Only the bark can pass beyond the uppermost debarking shaft 3', whereby a free passage 7 has been arranged for this bark, along which it can be removed from the debarking mechanism 1.

In the example of FIG. 3, the said free passage 7 is formed by an opening arranged in the side wall 15 of the debarking mechanism 1, at the debarking shaft 3', through which opening the bark can freely fall down onto the bark conveyor underneath (not shown).

Figure 4:
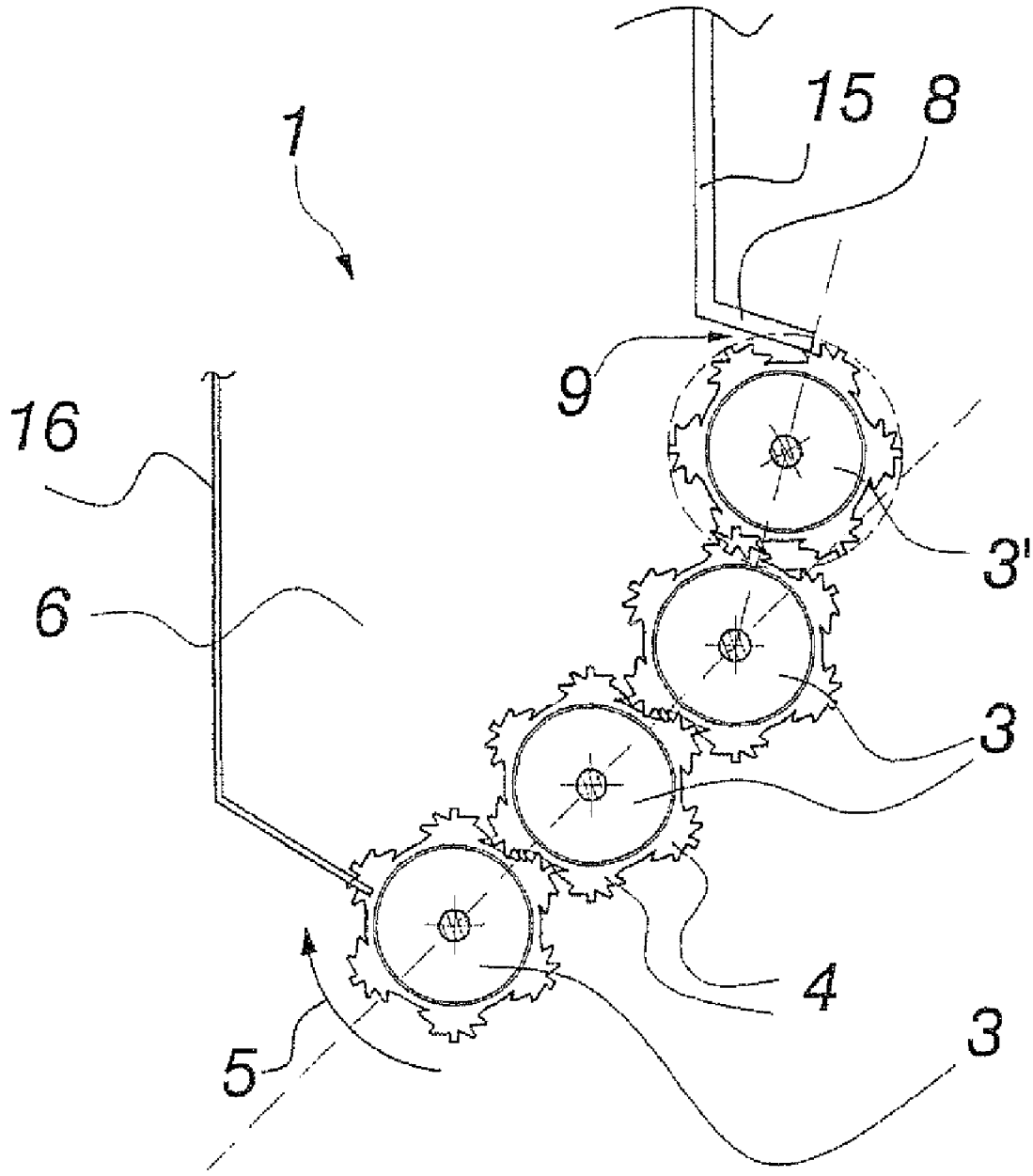
FIG. 4 shows a section according to FIG. 2 of the debarking mechanism in accordance with the second embodiment of the invention.

In the solution according to FIG. 4, a solid guiding surface 8 has been fitted in conjunction with the uppermost debarking shaft 3', the said guiding surface forming, together with the uppermost debarking shaft 3', a slot 9 converging in the direction of rotation 5 of the debarking shaft 3'. In the example of FIG. 4, the guiding surface 8 is a plate-like straight surface, but it may also have a different shape, for example that of an arched surface. The purpose of the guiding surface 8 is primarily to guide the bark as efficiently as possible out of the debarking mechanism 1, but at the same time to prevent logs 2 occasionally passing beyond the uppermost debarking shaft 3' from leaving the debarking mechanism 1 or from being wedged between the uppermost debarking shaft 3' and the side wall 15 of the debarking mechanism 1. The guiding surface 8 is arranged so that the bark conveyed by the uppermost debarking shaft 3' collide with it in a sharp angle while travelling towards the slot 9.

Figure 5:
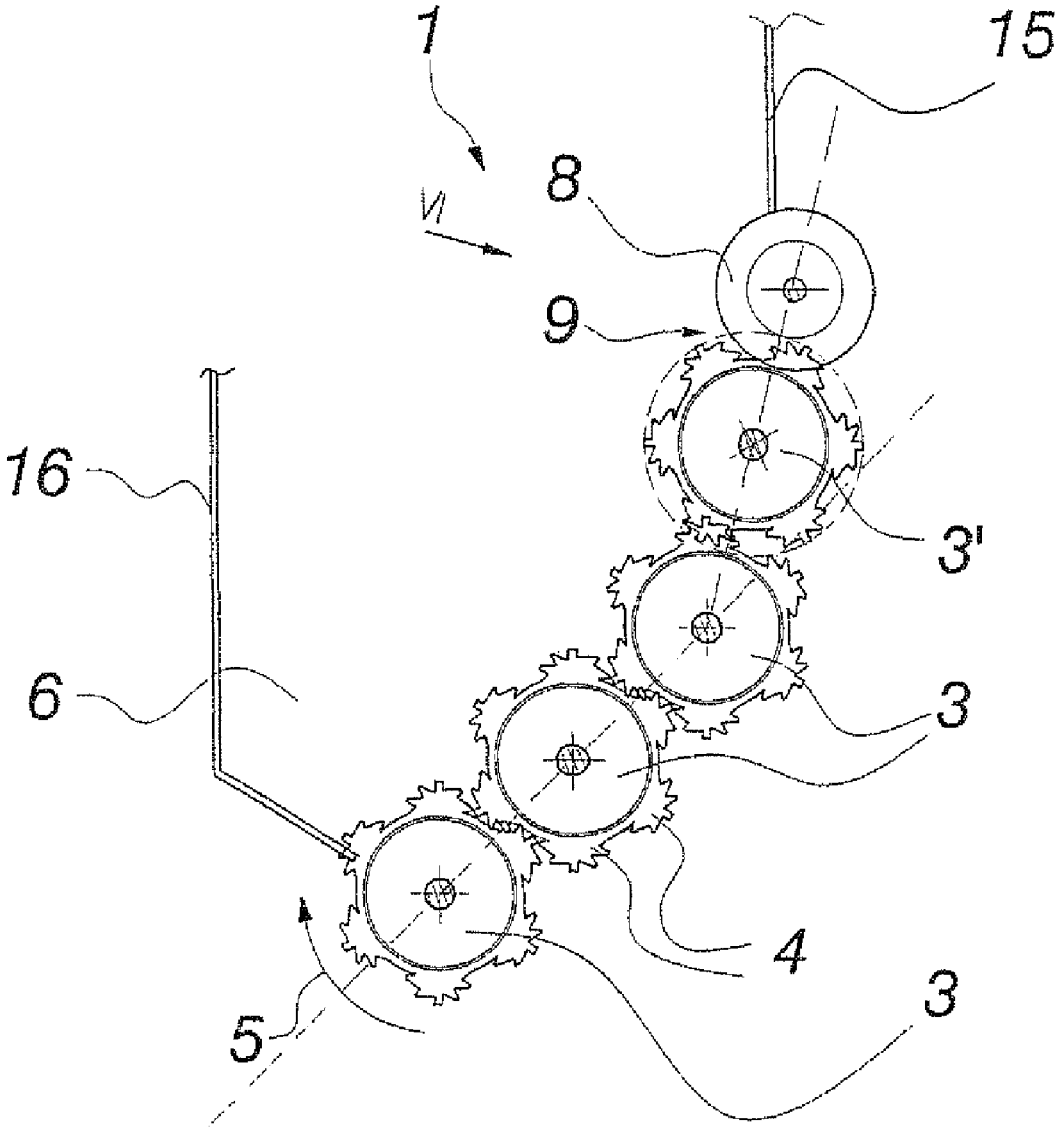
FIG. 5 shows a section according to FIG. 2 of the debarking mechanism in accordance with the third embodiment of the invention.

In the example of FIG. 5, the guiding surface 8 is formed by a toothless, freely rotating or independently rotatable roller resembling the debarking shafts 3, 3' in structure, whereby the teeth 4 of the uppermost debarking shaft force the bark to be discharged through the slot 9 between the uppermost debarking shaft 3' and the roller 8.

Figure 6:
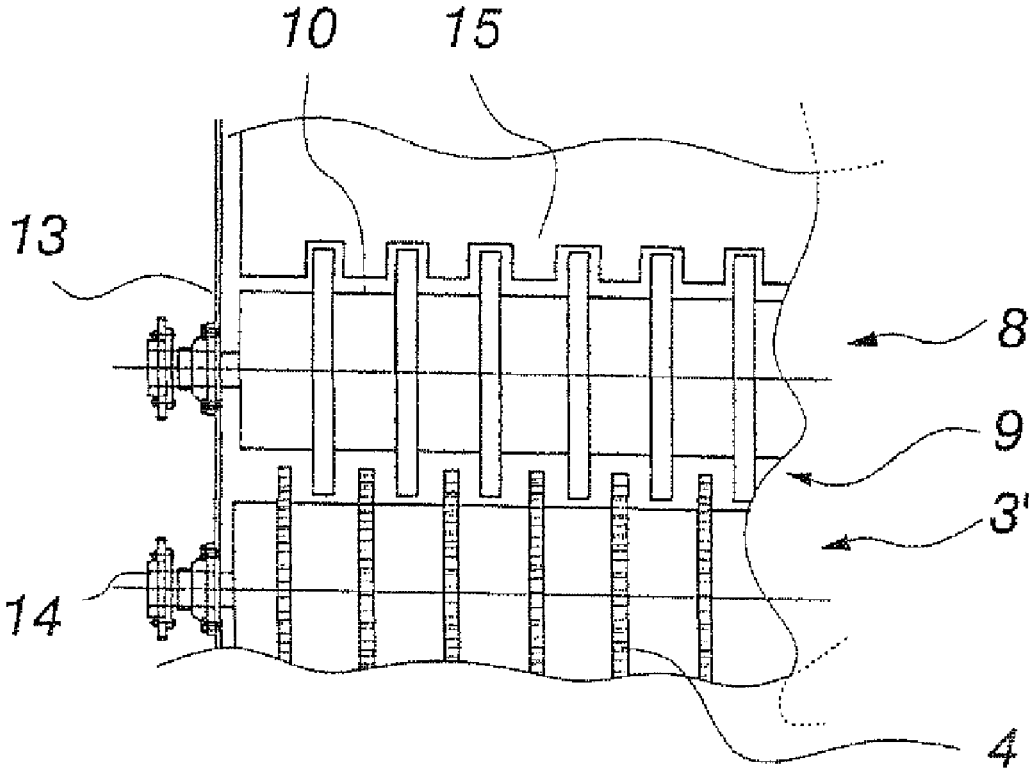
FIG. 6 shows a partial view in the direction of arrow VI in FIG. 5.

The guiding surface 8 is—regardless of whether it is a rotating or fixed guiding surface, or whether the guiding surface has a plate-like, cylindrical or some other form—preferably provided with grooves 10 for interlocking the said guiding surface and the teeth 4 of the uppermost debarking shaft 3' and for thus forming a slot 9 of the desired size (FIG. 6). Due to this arrangement, bark that has been pushed through the slot 9 at some point as forced by the tooth 4, can no longer easily return through the slot 9, whereby the adjacent teeth 4 will force also the rest of the bark strip to pass through the slot 9. The movable guiding surface 8 formed by the rotatable or freely rotating roller further facilitates the entry of the bark into the slot 9 and out of the debarking mechanism 1 therethrough.

The invention claimed is:

1. A debarking mechanism comprising:

a plurality of rotatable debarking shafts parallel to an advancing direction of logs moving through the debarking mechanism, each of the debarking shafts pivotably mounted on end plates, wherein the debarking shafts are between the end plates;

each of said debarking shafts provided with a plurality of teeth extending radially outwardly from a peripheral surface of each of the debarking shafts, wherein said teeth are arranged to strip bark off the logs and move the logs transversely to longitudinal axes of the logs, and said teeth convey the logs transversely to the shafts in a log advancing direction through the debarking mechanism, the debarking shafts form at least a part of a support surface of the debarking mechanism wherein the support surface includes a lower portion and a sidewall portion, wherein: (i) the debarking shafts support the logs travelling through the debarking mechanism, (ii) an upper debarking shaft of the plurality of debarking shafts has a longitudinal axis offset from a plane including the longitudinal axes of the other debarking shafts of the plurality of debarking shafts, and (iii) the debarking shafts each rotate about their longitudinal shaft axis, wherein the logs on the debarking shafts are rotated and moved upwardly within the debarking mechanism by the rotary motion of the debarking shafts;

an opposing support surface opposite to the sidewall portion of the support surface, wherein the logs in the debarking mechanism are between the opposing support surface and the support surface, and the offset of the longitudinal axis of the upper debarking shaft is towards the opposing support surface;

an open-ended chute for the logs having a first sidewall and a bottom surface which are at least partially formed by the debarking shafts, the chute includes an opposite sidewall including the opposing support surface, wherein the logs are parallel to and between the first sidewall, bottom surface and the opposite sidewall when in the chute;

wherein two or more of the debarking shafts each rotate at a rotational speed greater than a rotational speed of a lower one of the debarking shafts, wherein the two or more of the debarking shafts are at a higher elevation than the lower one of the debarking shafts; and a bark passage in the first sidewall which is above the uppermost debarking shaft allows bark to be discharged from the chute and blocks the logs moving through the bark passage.

2. A debarking mechanism as in claim 1, wherein the sidewall of the support surface further comprises a guiding surface above the upper debarking shaft, wherein the passage for bark is between the upper debarking shaft and a lower edge of the guiding surface.

3. A debarking mechanism as in claim 2, wherein the guiding surface include grooves which interlock with the teeth of the upper debarking shaft.

4. A debarking mechanism as in claim 2 wherein the lower edge of the guiding surface is formed by a freely rotating roller.

5. A debarking mechanism as in claim 2 wherein a rotatable roller forms the lower edge of the guiding surface.

6. A debarking mechanism as in claim 1 wherein said opposing support surface includes a fixed lower edge adjacent a lowest debarking shaft blocking logs from moving between the lowest debarking shaft and the fixed lower edge.

7. A debarking mechanism comprising:

a open-ended chute adapted to receive logs at one end of the chute and discharge logs from an opposite end of the chute, wherein the chute has a first sidewall, a lower surface and an opposite sidewall, wherein the logs are parallel to and between the first sidewall, lower surface and the opposite sidewall when in the chute;

the first sidewall and lower surface include a plurality of rotating debarking shafts each having longitudinal axes perpendicular to a direction of circulation of logs in the debarking mechanism, each of said debarking shafts having a cylindrical surface and teeth extending beyond the cylindrical surface, wherein said teeth strip bark off the logs and move the logs through the chute transversely to the longitudinal axes of the debarking shafts;

each of the debarking shafts pivotably mounted on end plates, wherein the debarking shafts are between the end plates and the end plates are at opposite ends of the chute;

each debarking shaft rotates about its longitudinal shaft axis and a plurality of the debarking shafts rotate at faster speeds than a rotational speed of a lowest debarking shaft which is at a lowest elevation of the plurality of debarking shafts, wherein the logs are rotated and are moved upwardly during the circulation by the rotating debarking shafts;

an upper debarking shaft of the plurality of debarking shafts has a longitudinal axis offset in a direction towards the opposite sidewall from a plane including the longitudinal axes of other debarking shafts of the plurality of debarking shafts;

a guide surface above the upper debarking shaft, and a passage for bark between the upper debarking shaft and the guiding surface, wherein the passage allows the passage of bark and blocks the passage of the logs.

8. A debarking mechanism as set forth in claim 7 wherein the guiding surface include grooves interlocking with the teeth of the upper debarking shaft.

9. A debarking mechanism as set forth in claim 7 wherein a lower edge of the guiding surface is formed by a freely rotating roller.

10. A debarking mechanism comprising:

a open-ended chute adapted to receive logs at one open end of the chute and discharge logs from an opposite open end of the chute, the chute includes a first sidewall and an opposite sidewall, and a lower surface between the first and opposite sidewalls, wherein the logs are parallel to and between the first sidewall, opposite sidewall, and lower surface when in the chute;

a plurality of rotating debarking shafts form a lower region of the first sidewall and at least a portion of the lower surface, the plurality of rotating debarking shafts each include debarking teeth extending radially outward from each of the debarking shafts;

each debarking shaft having a first end and an opposite end, wherein the first end is rotatably mounted to a first end support device, and the opposite end is rotatably mounted to an opposite end support device, the first end support device is proximate to a first end of the first sidewall and the opposite end support device is proximate to the opposite sidewall of the first sidewall;

the debarking shafts each rotate about a longitudinal axis of the shaft, wherein a plurality of the debarking shafts at upper elevations rotate faster than at least one of the debarking shafts at a lower elevation;

the axis of an uppermost one of the debarking shafts is offset in a direction towards the opposing sidewall from a plane formed by the longitudinal axes of at least another two the debarking shafts;

the first sidewall of the chute includes a guide sidewall surface above and parallel to the uppermost one of the debarking shafts, and a gap between a lower edge of the guide sidewall surface and the uppermost one of the debarking shafts allows the passage of bark through the gap, and prevents the passage of logs through the chute.

* * * * *